US005077863A

United States Patent [19]

Rench

[11] Patent Number: 5,077,863

[45] Date of Patent: Jan. 7, 1992

[54] CARPET CLEANING MACHINE WITH PERIMETER VACUUM CAPABILITY

[75] Inventor: Geoffrey B. Rench, Racine, Wis.

[73] Assignee: Racine Industries, Inc., Racine, Wis.

[21] Appl. No.: 607,231

[22] Filed: Oct. 31, 1990

[51] Int. Cl.[5] ..... A47L 5/30

[52] U.S. Cl. ..... 15/384; 15/415.1; 15/418; 15/419; 15/320

[58] Field of Search ..... 15/320, 384, 418–421

[56] References Cited

U.S. PATENT DOCUMENTS

| | | | |
|---|---|---|---|
| 664,135 | 12/1900 | DuFour | 15/384 X |
| 1,268,963 | 6/1918 | Gray | 15/419 X |
| 1,891,504 | 12/1932 | Smellie | 15/384 |
| 2,064,852 | 12/1936 | Riebel, Jr. et al. | 15/377 X |
| 2,064,856 | 12/1936 | Riebel, Jr. | 15/377 X |
| 2,659.925 | 11/1953 | Wood | 15/418 |
| 3,100,907 | 8/1963 | Schwertl | 15/418 X |
| 3,491,399 | 1/1970 | Dolan et al. | 15/418 X |
| 3,837,038 | 9/1974 | Kimzey et al. | 15/340.3 X |
| 3,840,935 | 10/1974 | Fitzgerald, Jr. et al. | 15/322 |
| 4,254,525 | 3/1981 | Combest | 15/419 X |
| 4,267,617 | 5/1981 | Brown et al. | 15/320 |
| 4,419,784 | 12/1983 | Lex | 15/344 |
| 4,426,751 | 1/1984 | Nordeen | 15/384 |
| 4,756,048 | 7/1988 | Kauffeldt et al. | 15/320 |

*Primary Examiner*—Chris K. Moore

*Attorney, Agent, or Firm*—Jansson & Shupe, Ltd.

[57] ABSTRACT

A carpet cleaning machine includes a pair of counter-revolving brushes for stroking the granules into and across the carpet fibers. A shroud is positioned above the brushes, has a bottom surface spaced from the brushes and generally forms a chamber around the brushes. The machine has at least one vacuum nozzle with its inlet opening into the chamber for creating a vacuum therein. The shroud terminates in a lower perimeter having a front edge, a rear edge and two side edges extending between the front edge and the rear edge. The side edges may be essentially in contact with the carpet at all times but at least the front edge and the rear edge are spaced upward from the carpet. Such front and rear edges define a granule exit opening between each edge and the carpet. A skirt is attached at the front edge and at the rear edge and each such skirt is movable with respect to such edge for closing the exit openings when removing granules from the carpet. The skirts thereby cause high velocity air to be drawn through and across the carpet fibers for more efficient removal of such granules.

22 Claims, 6 Drawing Sheets

CARPET CLEANING MACHINE WITH PERIMETER VACUUM CAPABILITY

FIELD OF THE INVENTION

This invention is related generally to carpet cleaning machines and, more particularly, to a carpet cleaning machine which sequentially applies cleaning granules to carpet for removing dirt therefrom and removes such granules by vacuuming.

BACKGROUND OF THE INVENTION

The three primary approaches used to clean commercial and residential carpets are steam or hot water, foam and dry systems. Dry-type carpet cleaning systems are further divided into two broad categories, namely, those using a dry or substantially dry powder and those using granules which are slightly moistened with cleaning solvents for dirt removal. The invention has utility in both categories of dry systems but relates primarily to those using granules rather than powder. Such machine also has utility in situations where only carpet vacuuming is performed. That is, its aggressive, long-bristled brushes are highly effective in removing loose sand and other soil not requiring the application of solvent-bearing material.

Of the dry granular carpet cleaning systems, the best known and most widely used is the HOST® dry extraction system offered by Racine Industries, Inc. of Racine, Wis. The HOST® system applies granules to carpet fibers using a machine as shown in Rench et al. U.S. Pat. Nos. 2,842,788 and 2,961,673. Such machine, sold under the HOST® trademark, is devoid of vacuum capability and has a pair of spaced brushes counter-rotating at relatively low speed (about 350 rpm) to stroke the cleaning granules into, through and across carpet fibers. The granules are referred to as "dry" and are substantially so even though moistened with cleaning solvents. When stroked as described, these granules "scrub" soil and dirt from such fibers including oily and non-oily soil. The carpet is cleaned by working the HOST® machine across it in different directions. During the clearing process, granules migrate to the carpet backing adjacent the base of the fiber. A few granules also adhere lightly to the fibers along their lengths. Following cleaning, conventional carpet vacuum machines are used for removing the dirt-ladened granules.

Because of the way they are constructed, conventional vacuum machines are not ideally suited for the removal of such dirt-ladened granules although such machines do a reasonably acceptable job of such removal. In particular, most such machines employ a single "beater bar" which rotates at high speed and which uses spaced rows of relatively short bristles. A few such machines have two beater bars which are constructed and operate in much the same way. Such high speed beater bars with short bristles are more effective in removing granules near the tops of the fibers but significantly less so as to granules which are "deep down" in the carpet.

In such conventional machines, it is not possible to apply the beater bar alone to the carpet, i.e., to use such bar with the vacuum nozzle raised above the carpet. In other words, the beater bar and the vacuum nozzle are used simultaneously to clean the carpet.

Another disadvantage of such machines is that the beater bars are driven by smooth-surfaced, flexible rubber belts which wrap partially around the bar. The solvent used to moisten the granules often causes the belt to slip, thereby temporarily disabling the beater bar.

Further, the embodiment of carpet brushing and carpet vacuuming capabilities in two separate machines means that two separate machines must be available to complete the cleaning process. This represents an extra equipment expense and for the professional carpet cleaner, it also represents added time (reflected in employee wages) required to get the necessary machines to the job site and to later remove such machines.

One type cf carpet machine is shown in Smellie U.S. Pat. No. 1,891,504. The Smellie machine uses two counter-revolving bars, commonly known as "beater bars," each having two elongate brushes. For each bar, the two brushes thereon are positioned about 180° apart and are arranged in a gentle spiral. Each brush is shrouded over its entire length and over about 90° of its circumference. An elongate vacuum inlet is positioned adjacent the perimeter of each brush and dirt extracted from the carpet by the brushes is drawn into these vacuum inlets and thence to a dust collector. The Smellie machine is constructed such that the nozzle lips and the brushes are simultaneously brought into contact with or moved away from the surface of the carpet being cleaned.

The vacuum cleaner shown in the Riebel, Jr. U.S. Pat. No. 2,064,856 and Riebel, Jr. et al. U.S. Pat. No. 2,064,852 employs a single beater bar on which is alternately mounted brush elements and beaters. Vacuum inlets are defined on either side of the beater bar. The machine is depicted to draw a carpet up against the vacuum nozzle where it is struck by the beater bar. Presumably, dust and dirt are thereby removed. As with the Smellie cleaner, the vacuum nozzle and the beater bar must move simultaneously to contact the carpet or be removed therefrom. Somewhat similar carpet vacuuming machines are shown in Nordeen U.S. Pat. No. 4,426,751 and Dufour U.S. Pat. No. 664,135.

Notwithstanding the efficacy of these earlier machines, they do not address the particular requirements arising from the application of dry cleaning granules to a carpet and subsequently removing such granules using the same machine. In particular, application of such granules requires that the machine brushes be free to engage and distribute a mound of cleaning granules as such granules are worked into the carpet and across the carpet fibers. Granule redistribution, important for uniform cleaning, is aided by having a significant space between the carpet and the machine shroud so that granules thrown about by the brushes are redistributed upon the carpet in many directions.

On the other hand, removal of these granules from the carpet by vacuuming is very effectively accomplished by a machine which can be closely "fitted" to the carpet surface, thereby forcing high-velocity, granule-entraining air to be drawn through the carpet fibers and upward into the vacuum inlet for improved granule removal. Earlier workers in this field did not appreciate how these two seemingly inconsistent requirements may be met by a single machine.

An improved carpet cleaning machine having a shroud with edges spaced from the carpet during the application of dry cleaning granules and a movable skirt disposed around such edges for closing these spaces when removing granules by vacuuming would be an important advance in the art.

OBJECTS OF THE INVENTION

It is an object of this invention to overcome some of the problems and shortcomings of the prior art.

Another object of this invention is to provide an improved carpet cleaning machine which combines features for brushing carpet fibers using dry cleaning granules and for later vacuuming such granules from the carpet.

Another object of this invention is to provide an improved carpet cleaning machine having a shroud with edges spaced from the carpet to define openings by which cleaning granules may exit for redistribution on the carpet.

Yet another object of this invention is to provide an improved carpet cleaning machine having skirts at such edges and movable with respect thereto for closing such openings when the granules are removed from the carpet by vacuuming.

Still another object of this invention is to provide an improved carpet cleaning machine wherein such skirts may be positioned to cause high-velocity air to be drawn through and across the carpet fibers for more efficient removal of carpet cleaning granules. These and other important objects will be apparent from the descriptions of this invention which follow.

SUMMARY OF THE INVENTION

The HOST ® carpet cleaning machine as described above and as depicted in the aforementioned Rench et al. patents has a pair of spaced counter-revolving brushes, the bristles of which are relatively long, relatively stiff and substantially evenly distributed. Such brush arrangement has long been demonstrated to be highly effective in brushing the HOST ® dry cleaning granules into, through and across carpet fibers, even relatively long carpet fibers. Such brushes also redistribute the granules by "digging" the granules out of the carpet including those which have migrated deep into the carpet to the backing. The brushes cast the granules from bristle tips to be again worked into and out of the fibers.

When so cast, the granules strike the entirety of the bottom surface of the shroud which is placed over and partially around the brushes. Although many moist granules adhere to such surface (and are readily removed by jostling the machine), many do not. The latter granules emerge through the exit openings defined between the bottom edges of the shroud and the carpet and are thereby redistributed on the carpet for further carpet cleaning.

The inventive machine incorporates movable skirts at the bottom edges of the shroud whereby the granule exit openings may be closed during vacuuming. The improved machine also includes a vacuum capability for granule removal.

The machine includes a pair of counter-revolving brushes for stroking the granules into and across the carpet fibers. A shroud is positioned above the brushes, has a bottom surface spaced from the brushes and generally forms a chamber around the brushes. The machine has at least one vacuum nozzle with its inlet opening into the chamber for creating a vacuum therein.

The shroud terminates in a lower perimeter having a front edge, a rear edge and two side edges extending between the front edge and the rear edge. The side edges may be essentially in contact with the carpet at all times but at least the front edge and the rear edge are spaced upward from the carpet. Such front and rear edges define a granule exit opening between each edge and the carpet. A skirt is attached at the front edge and at the rear edge and each such skirt is movable with respect to such edge for closing the exit openings when removing granules from the carpet. The skirts thereby cause high velocity air to be drawn through and across the carpet fibers for more efficient removal of such granules.

In one preferred embodiment, the skirts are formed of a substantially imperforate, flexible material which is brought into contact with the carpet fibers to obstruct the granule exit openings. The skirt material is held in an opening-obstructing position by resilient means. Such resilient means may be embodied as a plurality of springs urging the material toward the carpet or as an elastic cord which retains the skirt in such position.

In another preferred embodiment, the material itself is elastic and once so placed, retains itself in an opening-obstructing position while granules are being vacuumed from the carpet. In yet another preferred embodiment, each skirt includes an upper, substantially rigid portion attached at an edge and a lower portion attached to the upper portion and in contact with the carpet fibers to obstruct the granule exit openings during removal of granules from carpet.

A variation of the foregoing involves a shroud wherein the two side edges are also spaced upward to define a granule exit opening between each side edge and the carpet. Skirts similar to those described above are attached at each of the side edges and are movable with respect to such side edges for opening and closing the exit openings.

The vacuum nozzle(s) of the improved machine are arranged in one of two ways. The brushes are generally cylindrical in shape and the shroud has a front portion and a rear portion. These portions are generally conformably shaped to the curvature of the brushes and a platform is positioned between such portions. In one arrangement, a single vacuum nozzle is mounted in the platform so that its inlet is centered between and spaced above the brushes. Two panels extend downward from the inlet toward the brushes and aid in retrieving granules.

In another arrangement, two vacuum nozzles are mounted, one each on the front portion and the rear portion immediately adjacent the platform. For either arrangement, the inlet openings of the nozzles are generally coincident with the bottom surface of the shroud.

The brushes and the vacuum nozzles can be operated independently of one another and vacuum capability provided in several way. One way is by a separate motor mounted on the machine. Another way is by a separate vacuum-creating machine connected to the carpet cleaning machine by a flexible hose. Such machine may be of the type having its own waste tank and motor like those sold under the "SHOP-VAC" name or it may be mounted on a motor vehicle.

Each brush is made of bristles and in the preferred machine, such bristles are relatively stiff and substantially continuously disposed about the brush. They deflect only slightly during machine operation and the machine is supported entirely by the counter-revolving brushes when in operation. The aforementioned Rench et al. patents are incorporated herein by reference for their teaching regarding the basic structure used to make the inventive machine.

DETAILED DESCRIPTIONS OF PREFERRED EMBODIMENTS

The FIGURES show the improved carpet cleaning machine 10 in accordance with the invention.

Understanding of the inventive machine 10 will be aided by an expanded explanation of the carpet cleaning system with which it is particularly suited to be used. However, it is to be appreciated that there are other granular-type dry carpet cleaning systems in use and the machine 10 will also work well with such systems.

The HOST® CARPET CLEANING SYSTEM

Figure 2:
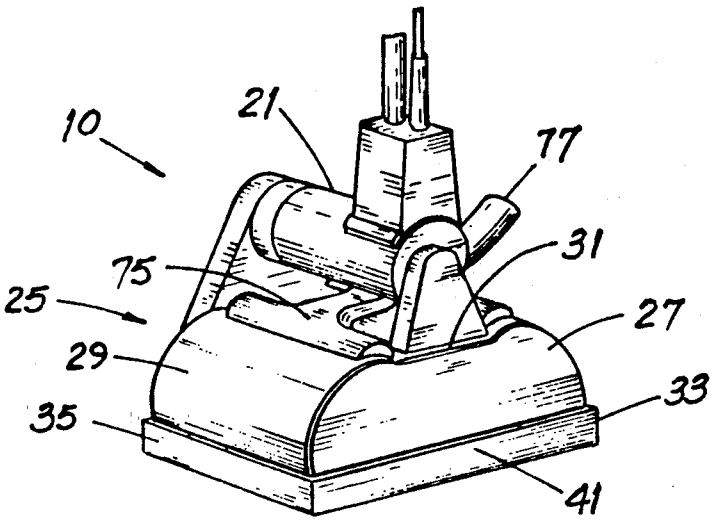
FIG. 2 is a perspective side elevation view of the side of the machine opposite that shown in FIG. 1.
Figure 1:
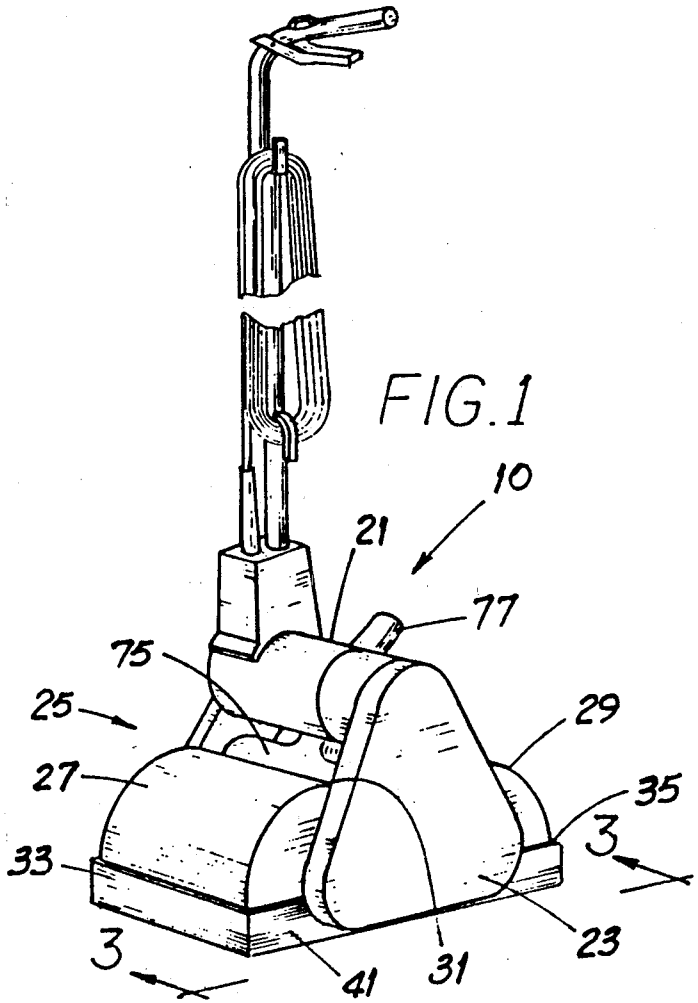
FIG. 1 is an elevation perspective view of the improved machine.
Figure 3:
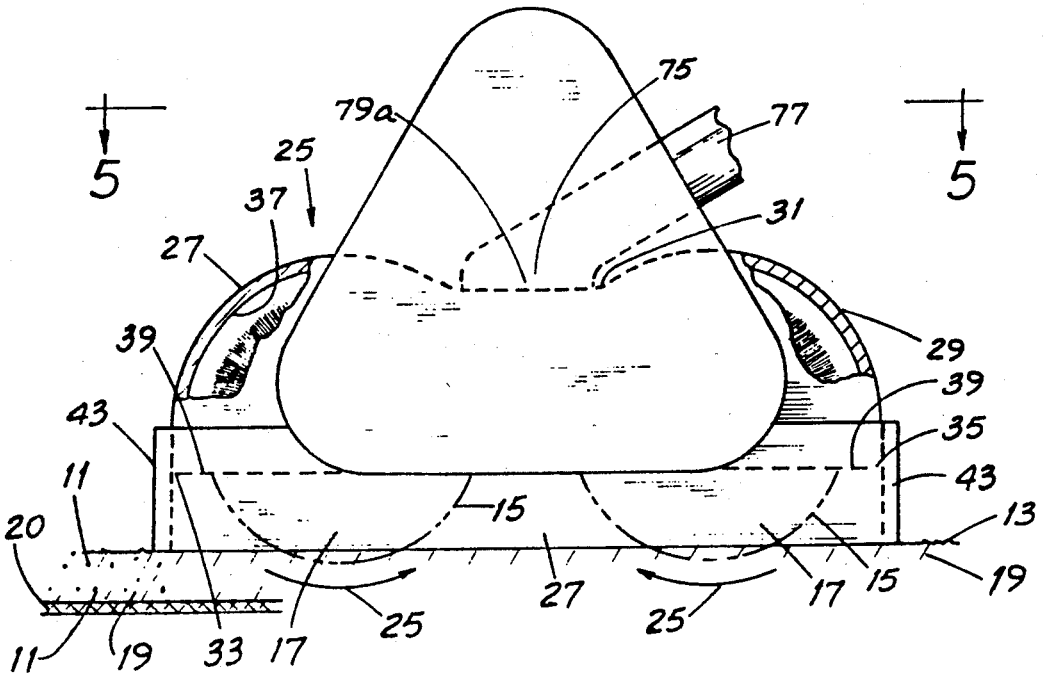
FIG. 3 is a side elevation view of a portion of the machine shown in FIGS. 1 and 2, taken along the viewing plane 3—3 of FIG. 1, with parts broken away, other parts shown in dotted outline and showing the skirts and one embodiment of the vacuum nozzle.

Referring first to FIG. 3, the HOST® dry carpet cleaning system uses cleaning granules 11 which are slightly moistened with cleaning solvents. These granules 11 are sprinkled on the carpet 13 by hand (much as one distributes grass seed upon turf) or by using an applicator drum designed for the purpose. After such granules 11 are relatively evenly distributed on the carpet 13, the counter-revolving brushes 15 of the machine 10 are actuated and their long, relatively stiff bristles 17 work the moistened granules 11 deep into the carpet pile and across the carpet fibers 19. These granules 11 are like thousands of tiny absorbing "scrubbers" which collect and retain dirt thereon.

To achieve optimum cleaning, the machine 10 (with vacuum de-activated) is worked across the carpet 13 in a forward and back motion which also includes lateral movement The pattern defined by the machine 10 is saw-toothed in shape. After completely covering and cleaning the carpet 13 in that manner, the machine 10 is re-oriented so that the direction of the forward and back motion is generally perpendicular to that used initially. The machine 10 may also be again re-oriented so that the direction of the forward and back motion is at about a 45° angle to those used previously.

As a result of this activity, the carpet fibers 19 are well cleaned and the dirt-laden granules 11 appear not only visibly at the top of the carpet 13 but also along the carpet fibers 19 and at the lower ends of the fibers 19 where they are joined to the carpet backing 20. These cleaning granules 11 have been so positioned by the action of the relatively stiff long bristled brushes 15 which repeatedly "stroke" the granules 11 across the fibers 19 by continuous redistribution and rebrushing.

Following such carpet cleaning, the granules 11 are removed by the machine 10 in the manner described below.

THE INVENTIVE MACHINE

The improved machine 10 is shown in FIGS. 1, 2, 3 and 4 and includes an electric motor 21 coupled to a pair of counter-revolving brushes 15 by a plurality of gear trains within the gear housing 23. Brush rotation is in the direction shown by the arrows 25 and is at about 350 rpm. The axes of rotation of the brushes 15 are generally parallel and located so that a space 27 is defined between the brushes 15. Each brush 15 is generally cylindrical and made of bristle tufts closely spaced to one another. The resulting appearance of the outer perimeter of the brush 15 is relatively uniform without significant spaces between tufts and with essentially no spaces delineating rows or groupings of bristles 17.

The bristles 17 are rather stiff and yield or bend only slightly as they engage the carpet fibers 19 and stroke the granules 11 into and through the fibers 19. The exposed length of the bristles 17 is about one-half of the radius of the brush 15. Because the weight of the machine 10 is supported entirely by the brushes 15 rotating in opposite directions, the machine 10 has little or no tendency to creep or drift across the carpet 13.

Interposed between the brushes 15 and the drive motor 21 is a protective shield or shroud 25 having a front portion 27, a rear portion 29 and a horizontal, generally planar platform 31 between the portions 27, 29. Each portion 27, 29 is shaped to conform generally to the curvature of the brush 15 associated therewith and terminates in a front edge 33 and a rear edge 35. These edges 33, 35 are generally parallel to and spaced above the carpet 13.

When the HOST® dry carpet cleaning granules 11 are initially distributed on the carpet 13 to be cleaned, such distribution is relatively even (or should be) and devoid of any significant mounds of such granules 13. When the motor 21 is actuated to drive the counter-revolving brushes 15, the granules 11 are worked into the carpet 13 and across the carpet fibers 19 to remove dirt therefrom. As the granules 11 are urged out of the carpet 13, they are "carried" at or near the tips of the bristles 17. As or soon after, the tips emerge from the carpet 13, the granules 11 are thrown or cast toward the bottom surface 37 of the shroud 25, striking such bottom surface 37.

While a number of granules 11 adhere to such bottom surface 37 because they are still moist (and are readily dislodged by jostling the machine), many do not. Those that do not are expelled from the granule exit openings 39 between the edges 33, 35 and the carpet 13. Therefore, the existence of spaces at least between the front and rear edges 33, 35 of the shroud 25 and the carpet 13 is important to granule re-distribution. Spaces between the side edges 41 of the shroud 25 and the carpet 13 are less important for granule re-distribution but must be considered when preparing to vacuum the granules 11 from the carpet 13.

The dry cleaning granules 11 may tend to mound or accumulate in one or a few locations, depending upon how the operator moves the machine 10 across the carpet 13. Accumulations having a depth of one-half inch or more are not uncommon. Therefore, the spaces between the front and rear edges 33, 35 of the shroud 25 and the carpet 13 are also important to prevent "bulldozing" these accumulations of granules 11 and preventing them from being re-engaged by the brushes 15 for further carpet cleaning. The spaces at such front and rear edges 33, 35 are also important in preventing such edges 33, 35 from "digging into" or catching on the carpet 13 as the machine 10 is rocked back and forth slightly during the carpet cleaning operation.

However, it has been found that spacing between the edges 33, 35 and the carpet 13 is distinctly disadvantageous when using the combined brushing and vacuuming capability of the machine 10 to remove the granules 11.

Figure 4:
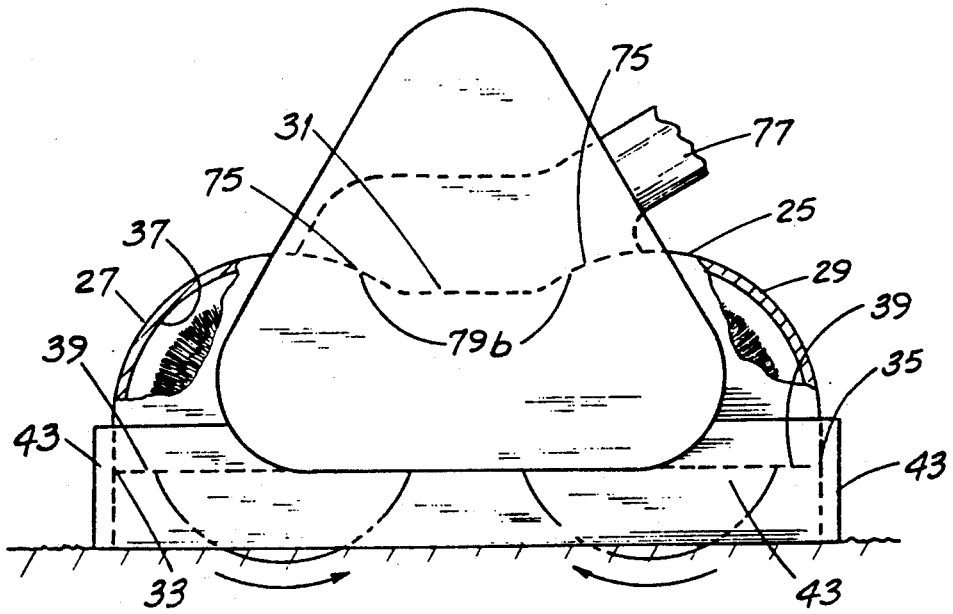
FIG. 4 is a generally side elevation view of a portion of the machine shown in FIGS. 1 and 2, taken along the viewing plane 3—3 of FIG. 1, with parts broken away, other parts shown in dotted outline and showing the skirts and another embodiment of the vacuum nozzle.

FIGS. 3 and 4 show the shroud 25 with a skirt 43 attached thereto. It should be appreciated that these FIGURES are intended to show the general arrangement of the skirt 43 on the shroud 25 and that specific embodiments of skirt 43 are depicted in other FIGURES. The manner in which vacuum is provided is described below.

As generally described above, the shroud 25 terminates the front edge 33, the rear edge 35 and the two side edges 41 extending between the front edge 33 and the rear edge 35. The side edges 41 may or may not be essentially in contact with the carpet 13 at all times but at least the front edge 33 and the rear edge 35 are spaced upward from the carpet 13 to define the granule exit openings 39. A skirt 43 is attached at the front edge 33 and at the rear edge 35 and each such skirt 43 is movable with respect to such edge 33, 35 for closing the exit openings 39 when removing granules 11 from the carpet 13. As further described below, the skirts 43 cause high velocity air to be drawn through and across the carpet fibers 19 for more efficient removal of such granules 11.

If the shroud 25 is constructed so that its side edges 41 are spaced significantly from the carpet 13 (rather than touching the carpet 13 or being in very close proximity thereto) a skirt 43 is also attached to the shroud 25 along such side edges 41. All skirts 43 extend downward toward the carpet 13 to lightly touch the carpet 13 or extend slightly into its fibers 19, thereby providing a relatively good seal between the skirts 43 and the carpet 13. At least, all such skirts 43 should be in very close proximity to the carpet 13 when they are positioned for granule removal by vacuuming.

Figure 5:
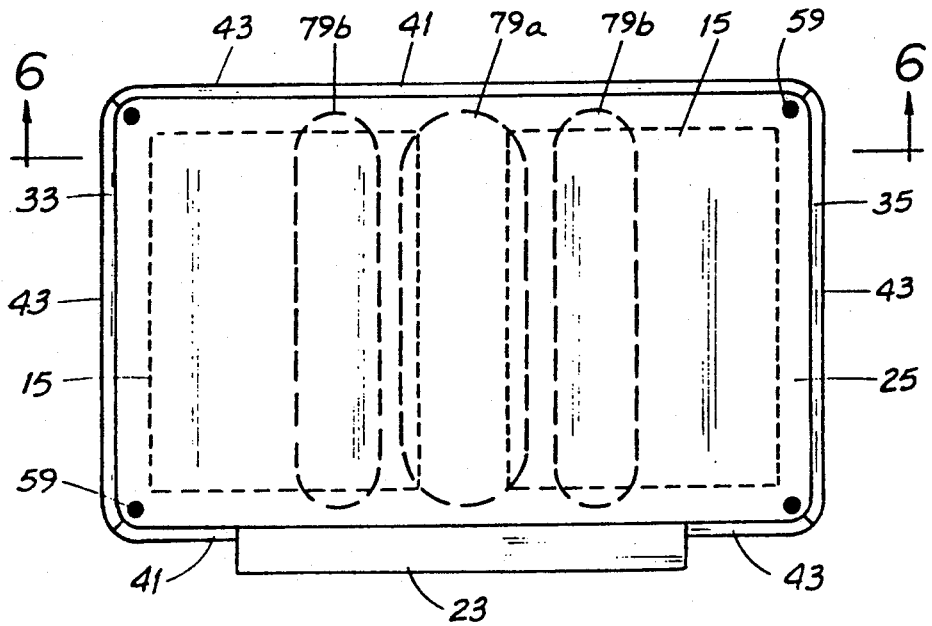
FIG. 5 is a top plan view of the portion of the machine shown in FIG. 3, with parts omitted and other parts shown in dotted outline.

FIG. 5 shows how the skirts 43 extend around the entire lower perimeter of the shroud 25 and assumes that all four edges 33, 35, 41 of the shroud 25 are spaced above the carpet 13 and therefore require skirts 43. It is apparent that if the left and right edges 41 of the shroud 25 are at least in very close proximity to the carpet 13, the skirts 43 adjacent thereto can be omitted.

Figure 6:
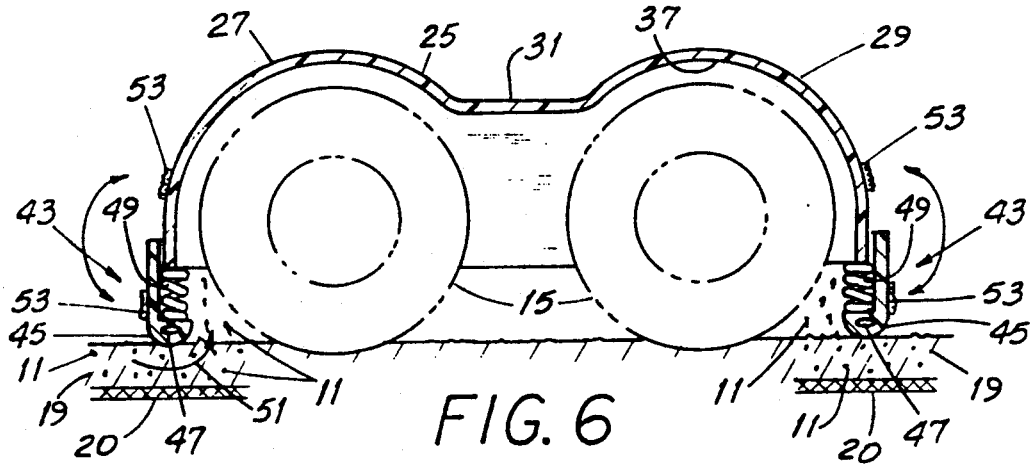
FIG. 6 is a cross-sectional side elevation view taken along the viewing plane 6—6 of FIG. 5 with parts shown in dotted outline and illustrating one embodiment of a movable skirt.

Referring next to FIG. 6, a first embodiment of a skirt 43 is formed of a substantially imperforate, flexible material in contact with the carpet fibers 19 to obstruct the granule openings 39 during the carpet vacuuming/granule removing step. Such material may be tightly woven cloth, canvas or vinyl, as examples. The skirt 43 has an inwardly turned lip 45 to help prevent the skirt 43 from unduly catching on the carpet 13. The lip 45 includes a relatively rigid elongate rod 47 embedded therein to provide a lip 45 which is substantially linear. Such rod 47 helps resist buckling of the skirt 43 due to the pressure differential across it during vacuuming and linearity helps maintain a good "seal" with the carpet 13.

The lip 45 is urged toward contact with the carpet 13 by a resilient spring 49 disposed at each of the corners of the machine 10. During carpet vacuuming operations, the skirts 43 are in the lowered position as shown. When in such position and when vacuum is applied, high velocity air is caused to be drawn through and across the carpet fibers 19 as shown by the arrow 51. Dirt-ladened granules 11 are thereby efficiently removed. During the initial carpet cleaning operation, the skirts 43 are folded upward against the shroud 25 and retained there by fasteners 53, e.g., VELCRO® fasteners or snaps.

Figure 7:
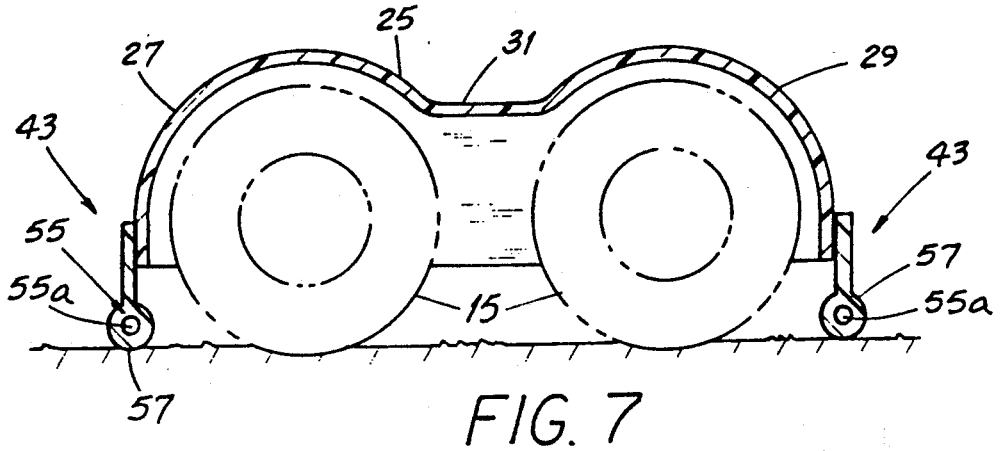
FIG. 7 is generally a cross-sectional side elevation view taken along the viewing plane 6—6 of FIG. 5 with parts shown in dotted outline and illustrating a second embodiment of a movable skirt.

Another embodiment of the skirt 43 is shown in FIG. 7 and is formed of a substantially imperforate, flexible material as described above. The skirt 43 is retained in the illustrated lowered position by resilient means 55 embodied as an elastic cord **55*a* embedded in the lower, rounded lip 57. It is to be understood that the skirts 43 shown in FIGS. 6 and 7 can be formed in one of several ways. For example, a single piece of material may be used as a "wraparound" skirt 43 or separate pieces of material may be used, one for each skirt 43. Additionally, the material from which the skirt 43 is made may itself be elastic or resilient, thereby eliminating the need for separate resilient means 55**.

In the arrangement of FIG. 7, the elastic cord **55*a* may tend to collapse or "roll" the skirt 43 inward toward the brushes 15 unless retained in a vertical position. To prevent such eventuality, a downwardly extending, somewhat resilient post 59 is mounted at each corner as shown in FIG. 5. The skirts 43** engage the posts and are thereby substantially prevented from collapsing inward.

Figure 8:
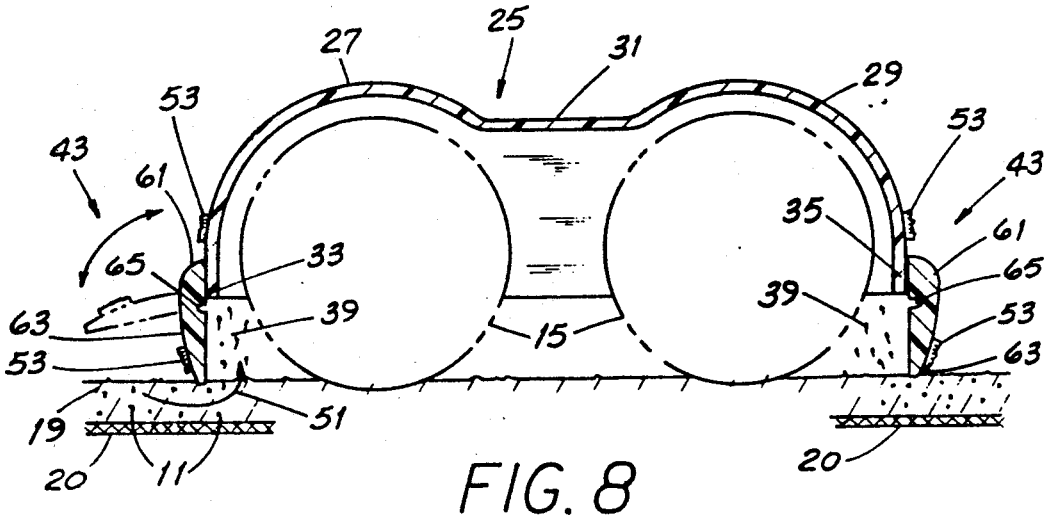
FIG. 8 is generally a cross-sectional side elevation view taken along the viewing plane 6—6 of FIG. 5 with parts shown in dotted outline and illustrating third embodiment of a movable skirt.

Yet another embodiment of a skirt 43 is shown in FIG. 8 and includes an upper, substantially rigid portion 61 attached at an edge 33, 35 of the shroud 25 and a lower portion 63 attached thereto. The vertical height of the lower portion 63 is selected such that it lightly contacts the carpet fibers 19 to obstruct the granule exit openings 39 during the vacuuming operation. In a highly preferred embodiment, the portions 61, 63 are made of relatively rigid plastic material such as vinyl or polypropylene. The portions 61, 63 are attached to one another by what is commonly known as a "living hinge 65." Such hinge 65 is comprised of a relatively thin section of plastic material which may be repeatedly bent or folded without cracking or fracturing. During carpet cleaning operations, the lower portion 63 is folded upward and held there by a VELCRO® fastener 53, for example.

Figure 9A:
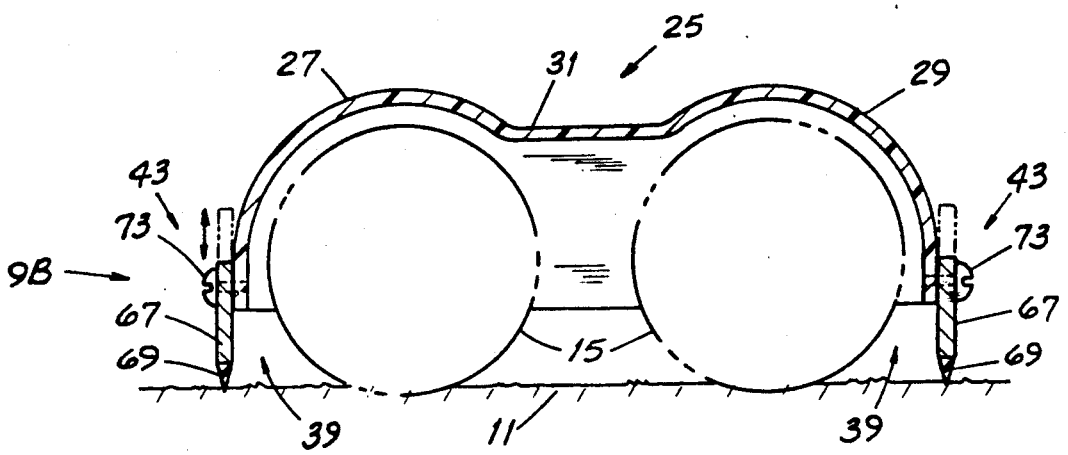
FIG. 9A is generally a cross-sectional side elevation view taken along the viewing plane 6—6 of FIG. 5 with parts shown in dotted outline and illustrating a fourth embodiment of a movable skirt.
Figure 9B:
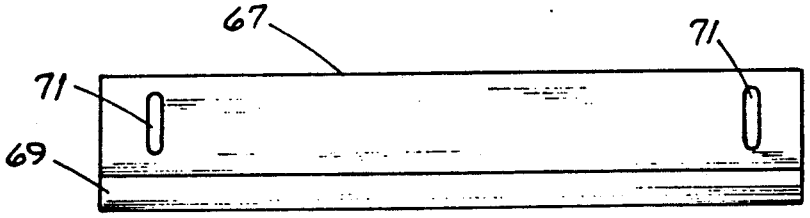
FIG. 9B is a elevation view of the skirt of FIG. 9A taken along the viewing axis 9B thereof.

In the embodiment shown in FIGS. 9A and 9B, the skirt 43 includes a rigid upper panel portion 67 with a resilient lip portion 69 extending downward from the lower edge of the portion 67. The portion 67 has a pair of vertically-elongate slots 71 formed in it for receiving a bolt or a screw 73. Before starting vacuuming, the screws 73 are loosened slightly and the skirt 43 lowered until the lip portion 69 lightly contacts the carpet 13, whereupon the screws 73 are tightened. During the initial cleaning operation, the skirt 43 is retained in an upward position so that neither portion 67, 69 substantially obstructs the exit opening 39.

From the foregoing, it is to be appreciated that a suitable skirt 43 may be embodied in any one or a combination of different design forms. Irrespective of the configuration used, a highly preferred skirt 43 is capable of being retained in contacting or closely proximate relationship with the top surface of the carpet 13 and is also capable of being retained in a position to avoid obstructing the granule exit openings 39 during the carpet cleaning step.

Either one vacuum nozzle 75 (FIG. 3) or two vacuum nozzles 75 (FIG. 4) have their inlets opening to the bottom surface 37 of the shroud 25 for creating a vacuum in the spatial areas around the brushes 15. When vacuum is applied to such nozzle(s) 75 as described below, granules 11 are received and drawn into the vacuum tube 77, thereby removing such granules 11 from the carpet 13.

Referring to FIGS. 3, 4 and 5, one or both vacuum nozzles 75 are located in recognition of the way in which granules 11 may be cast against the bottom surface 37 of the shroud 25. Such granules are "carried" at or near the tips of the bristles and following emergence of the tips from the carpet 13, the granules 11 are thrown or cast. Many of the granules 11 strike the bottom surface 37 of the shroud 25. However, they do so unevenly. That is, the pattern of granule impact is not uniform but rather, is somewhat more dense in a certain area or areas which define a "throw pattern."

In one embodiment (FIGS. 3 and 5), the area defining the throw pattern 79*a* (and therefore the location of the vacuum nozzle 75) is centered generally midway between the portions 27, 29 and coincident with the platform 31. In another embodiment (FIGS. 4 and 5), the areas defining the throw pattern 79*b* (and therefore the locations of the nozzles 75) are located on the portions 27, 29 of the shroud 25 and immediately adjacent the platform 31.

Figure 10:
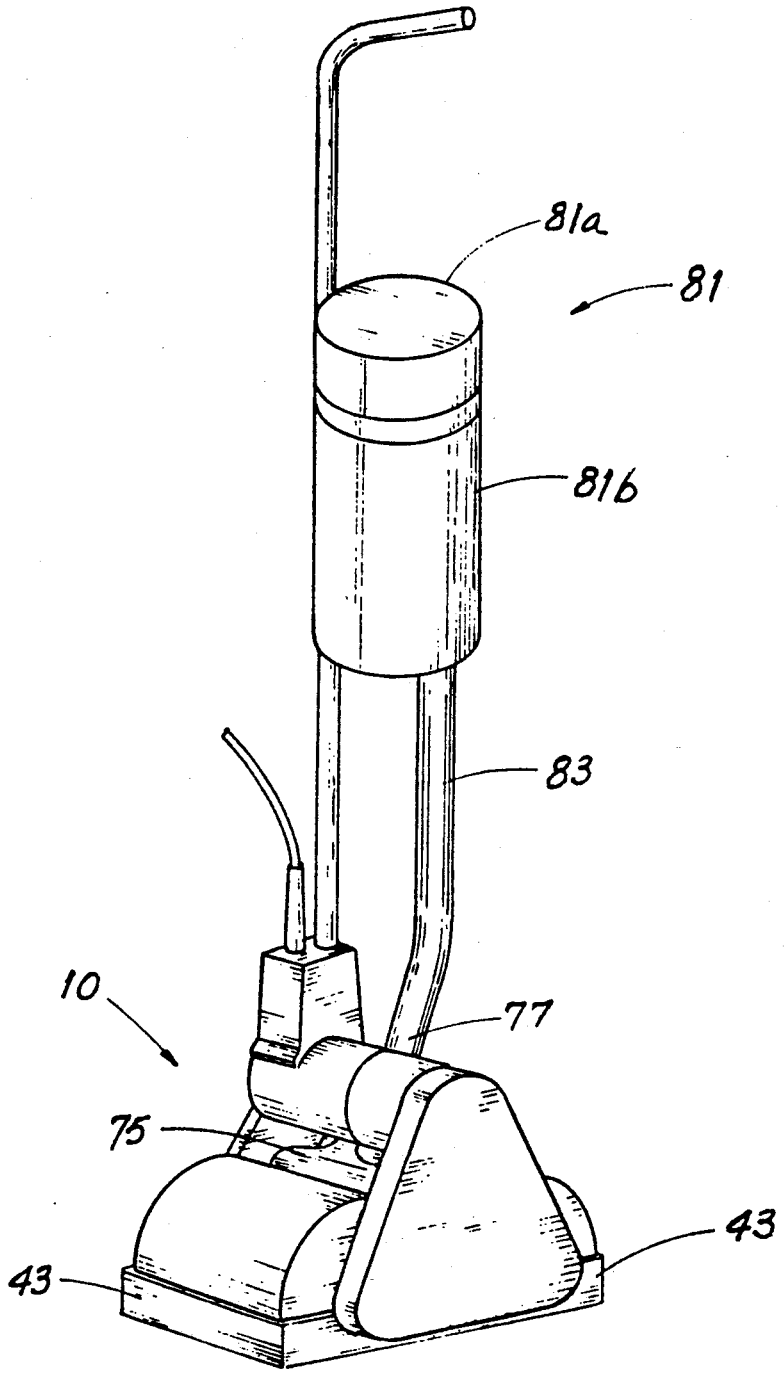
FIG. 10 is a simplified perspective view of the machine shown with a self-mounted, separately-operable vacuum unit.

Referring next to FIG. 10, the vacuum-creating machine 81 is embodied as a separate electric motor 81*a* and collector housing 81*b* mounted on the machine 10. The motor 81*a* may be separately energized and the collector housing 81*b* is connected to the tube 77 by a hose.

Figure 11:
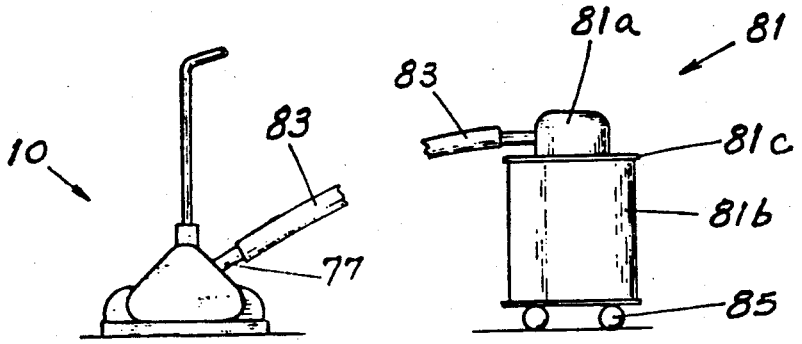
FIG. 11 is a simplified side elevation view of the machine shown in conjunction with a separate vacuum-creating machine connected thereto by flexible hose.

As shown in FIG. 11, the vacuum-creating machine 81 is embodied as a separate, free-standing machine 81*c* connected to the tube 77 of the machine 10 by a flexible hose 83. Such machines 81*c* are typically mounted on wheels 85 and have a separate collector tank 81*b* and a separate electric vacuum motor 81*a*.

Figure 12:
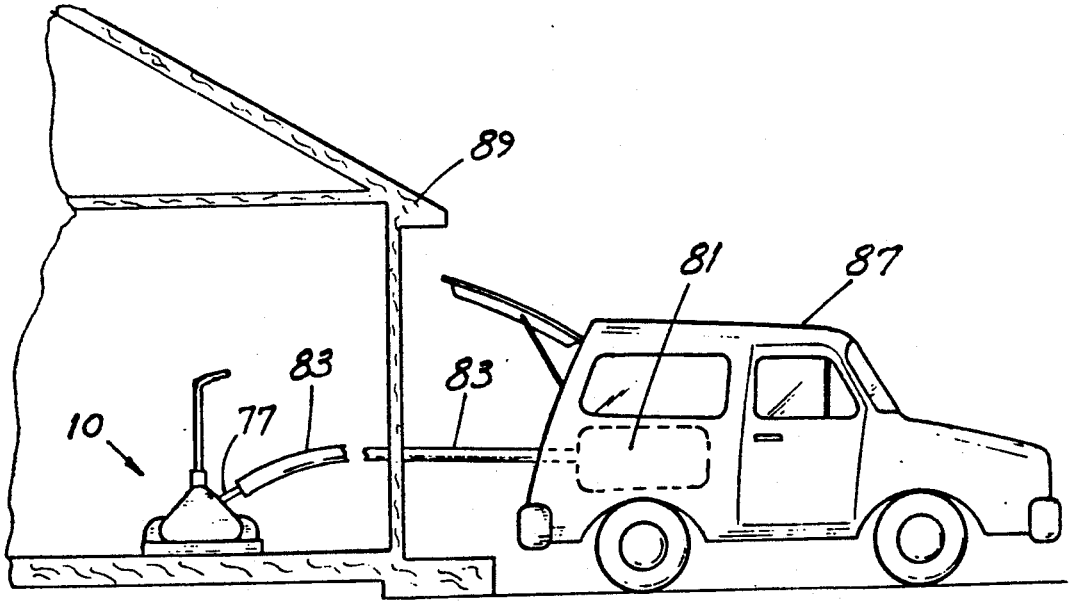
FIG. 12 is a simplified side elevation view, partly in cross section, of the machine shown in conjunction with a separate vacuum-creating machine (in dotted outline) mounted on a motor vehicle located exterior of the building in which the machine is used.

Yet another arrangement is shown in FIG. 12 wherein the vacuum-creating machine 81 is mounted on a motor vehicle 87 and is powered by its own drive motor or by the vehicle engine, neither being shown. When using the arrangement of FIG. 12, a flexible vacuum hose 83 extends from the vehicle 87 through a door or window of the building 89 in which the machine 10 used. It is to be appreciated that with any of the arrangements shown in FIGS. 10, 11, or 12, the counter-revolving carpet cleaning brushes 15 and the vacuum nozzle(s) 75 are operable independent of one another. It is also to be appreciated that where a plurality of nozzles 75 is used, such as is shown in FIG. 4, both such nozzles 75 operate simultaneously when the vacuum-creating machine 81 is energized.

Irrespective of the particular embodiment of the vacuum-creating machine 81, it should provide a vacuum of about 82–103 inches water at the end of the hose 83 adjacent the machine 10 and an air flow rate of about 100 to 120 cu. ft. per minute for most effective cleaning. The foregoing assumes the machine 10 has a "footprint" area on the carpet 13 of about 180 sq. in.

To use the inventive machine 10, the dry carpet cleaning granules 11, preferably those used in the HOST® system, are distributed atop the carpet 13. The skirts 43 are placed in the raised position to avoid obstructing the exit openings 39. Thereupon, the motor 21 is energized to drive the brushes 15 and the machine 10 worked across the carpet 13 to thoroughly brush the granules 11 into, through and across the carpet fibers 19, thereby thoroughly cleaning such fibers 19. During this cleaning operation, no vacuum is used, thereby making the entire quantity of distributed HOST® granules 11 available for carpet cleaning.

After cleaning, the skirts 43 are lowered to be in close proximity to or lightly touch the top surface of the carpet 13, thereby obstructing the granule exit openings 39. Then the brushes 15 and the vacuum-creating machine 81 are energized, the latter providing a vacuum at the inlet(s) of the nozzle(s) 75. The machine 10 is repeatedly passed over the surface of the carpet 13 to remove the dirt-ladened granules 11.

It has been found that the inventive machine 10 removes substantially all of the granules 11 from short-tufted commercial carpets 13. It has also been found that the machine 10 removes a much higher percentage of granules 11 from longer-tufted residential carpets 13 than do conventional commercial vacuum cleaners. Further, such granule removal is accomplished in about one-half the time otherwise required to remove fewer of the granules 11 using a conventional carpet vacuuming machine. Labor costs are thereby reduced.

Another advantage of the machine 10 is that the individual engaged in cleaning carpets 13, typically a professional carpet cleaner, need only purchase, store and move a single machine 10 from job to job rather than two separate machines. Such machine 10 can be used for granular carpet cleaning as described above or as a conventional vacuum cleaner to remove sand and other types of relatively loose soiling. Thus, the machine 10 provides a significant savings in initial investment and time.

While the principles of this invention have been described in connection with specific embodiments, it should be understood clearly that these descriptions are made only by way of example and are not intended to limit the scope of the invention.

What is claimed is:

1. An improved machine for cleaning a carpet made of fibers, such machine stroking substantially-dry cleaning granules into and through the carpet and removing such granules therefrom, the machine including:

a pair of counter-revolving brushes for stroking the granules into and across the carpet fibers;

a shroud having a bottom surface spaced from the brushes, such shroud forming a chamber;

at least one vacuum nozzle having an inlet for receiving granules to be removed from the carpet, such inlet opening into the chamber for creating a vacuum therein;

the shroud terminating in a lower perimeter having a front edge, a rear edge and two side edges extending between the front edge and the rear edge;

at least the front edge and the rear edge being spaced upward from the carpet to define a granule exit opening between each edge and the carpet;

a pair of skirts, one each attached at the front edge and at the rear edge and movable with respect to such edge for selectively closing the exit openings when removing granules from the carpet;

the skirts thereby causing high velocity air to be drawn through and across the carpet fibers for more efficient removal of such granules.

2. The machine of claim 1 wherein the skirts are formed of a substantially imperforate, flexible material which is in contact with the carpet fibers to obstruct the granule exit openings.

3. The machine of claim 2 wherein the skirts are held in an opening-obstructing position by resilient means embodied as a plurality of springs urging the material toward the carpet.

4. The machine of claim 2 wherein the skirts are held in an opening-obstructing position by resilient means embodied as an elastic cord.

5. The machine of claim 2 wherein the skirt material is elastic and retains itself in an opening-obstructing position during removal of granules from the carpet.

6. The machine of claim 1 wherein each skirt includes an upper, substantially rigid portion attached to a chamber edge and a lower portion attached to the upper portion and in contact with the carpet fibers to obstruct the granule exit openings during removal of granules from carpet.

7. The machine of claim 6 wherein the lower portion is substantially rigid and hinged to the upper portion and wherein means are provided for retaining the lower portion in a folded-up position, thereby avoiding obstruction of the granule exit openings when the granules are being worked into the carpet.

8. The machine of claim 6 wherein the vacuum nozzle and the brushes are operable independently of one another.

9. The machine of claim 6 wherein the vacuum nozzle has a vacuum capability and wherein such vacuum capability is provided by a separate motor mounted on the machine.

10. The machine of claim 6 wherein the vacuum nozzle has a vacuum capability and wherein such vacuum capability is provided by a separate vacuum-creating machine connected to the carpet cleaning machine by a flexible hose.

11. The machine of claim 10 wherein such vacuum-creating machine is mounted on a motor vehicle.

12. The machine of claim 6 wherein the brush has bristles, wherein such bristles are relatively stiff and substantially continuously disposed about the brush, wherein the bristles deflect only slightly during machine operation and wherein the machine is supported entirely by the counter-revolving brushes when in operation, thereby making such machine easier to push across a carpet.

13. The machine of claim 1 wherein the two side edges are spaced upward from the carpet to define a granule exit opening between each side edge and the carpet and wherein the machine further includes a pair of skirts, one each attached to each of the side edges, each skirt being movable with respect to such side edges for closing the exit openings adjacent the side edges when removing granules from the carpet.

14. The machine of claim 13 wherein at least one of the skirts is formed of a substantially imperforate, flexible material which is in contact with the carpet fibers to obstruct the granule exit openings.

15. The machine of claim 14 wherein the skirt is held in an opening-obstructing position by resilient means embodied as a plurality of springs urging the material toward the carpet.

16. The machine of claim 14 wherein the skirt is held in an opening-obstructing position by resilient means embodied as an elastic cord.

17. The machine of claim 14 wherein the skirt material is elastic and retains itself in an opening-obstructing position during removal of granules from the carpet.

18. The machine of claim 14 wherein each skirt includes an upper, substantially rigid portion attached to a chamber edge and a lower portion attached to the upper portion and in contact with the carpet fibers to obstruct the granule exit openings during removal of granules from carpet.

19. The machine of claim 18 wherein the lower portion is substantially rigid and hinged to the upper portion and wherein means are provided for retaining the lower portion in a folded-up position, thereby avoiding obstruction of the granule exit openings when the granules are being worked into the carpet.

20. The machine of claim 1 wherein the brushes are cylindrical wherein the shroud has a front portion and a rear portion, wherein such portions are generally conformably shaped to the curvature of the brushes, wherein a platform is positioned between the front portion and the rear portion and wherein the vacuum nozzle is mounted in the platform.

21. The machine of claim 1 further including a second vacuum nozzle and wherein the brushes are cylindrical wherein the shroud has a front portion and a rear portion, wherein such portions are generally conformably shaped to the curvature of the brushes, wherein a platform is positioned between the front portion and the rear portion and wherein a vacuum nozzle is mounted in the front portion and in the rear portion adjacent the platform.

22. The machine of claim 1 wherein the brush has bristles, wherein such bristles are relatively stiff and substantially continuously disposed about the brush, wherein the bristles deflect only slightly during machine operation and wherein the machine is supported entirely by the counter-revolving brushes when in operation, thereby making such machine easier to push across a carpet.

* * * * *